US007823581B2

(12) United States Patent
Velasquez et al.

(10) Patent No.: US 7,823,581 B2
(45) Date of Patent: Nov. 2, 2010

(54) REMOTE CONTROL FOR GAS VALVE

(75) Inventors: Juan F. Velasquez, Saline, MI (US); Barbara Happe, Gernrode (DE)

(73) Assignee: Maxitrol Company, Southfield, MI (US)

( * ) Notice: Subject to any disclaimer, the term of this patent is extended or adjusted under 35 U.S.C. 154(b) by 1179 days.

(21) Appl. No.: 11/403,553

(22) Filed: Apr. 13, 2006

(65) Prior Publication Data

US 2006/0254575 A1 Nov. 16, 2006

Related U.S. Application Data

(60) Provisional application No. 60/671,806, filed on Apr. 15, 2005.

(51) Int. Cl.
*F24B 1/187* (2006.01)

(52) U.S. Cl. ..... 126/503; 431/37

(58) Field of Classification Search ..... 126/500, 126/503; 431/37; 340/5.2
See application file for complete search history.

(56) References Cited

U.S. PATENT DOCUMENTS 5,450,841 A * 9/1995 Whitaker et al. ..... 126/512
5,654,813 A * 8/1997 Whitworth ..... 398/111
5,790,043 A * 8/1998 Hettich et al. ..... 340/5.62
6,404,703 B1 * 6/2002 Burrell ..... 367/128
6,486,795 B1 * 11/2002 Sobel et al. ..... 340/825.72

* cited by examiner

*Primary Examiner*—Steven B McAllister
*Assistant Examiner*—Sarah Suereth
(74) *Attorney, Agent, or Firm*—Howard & Howard Attorneys PLLC

(57) ABSTRACT

A gas valve (14) control system (10) uses a control signal (16) to enable a valve (14) and a validation signal (22) to validate the control signal (16). The system (10) includes a valve (14) connected to a burner (12). A receiver (18) is electrically connected to the valve (14) and provides the valve (14) with the control signal (16). A controller (20) has a control transmitter (24) in wireless communication with the receiver (18) to transmit the control signal (16) to the receiver (18) at a speed of light. The controller (20) further includes a validation transmitter (26) to transmit a validation signal (22) to the receiver (18) at a speed of sound. The valve (14) is enabled by the control signal (16) if a time delay between the receiver (18) receiving the control signal (16) and the validation signal (22) is shorter than a maximum delay period. The control signal (16) is discarded if the time delay is longer than the maximum delay period.

14 Claims, 5 Drawing Sheets

REMOTE CONTROL FOR GAS VALVE

CROSS REFERENCE TO RELATED APPLICATION

This application claims the benefit of application Ser. No. 60/671,806 filed Apr. 15, 2005.

BACKGROUND OF THE INVENTION

1. Field of the Invention

The subject invention relates to a gas valve control system for a heater that is remotely controlled.

2. Description of the Prior Art

Various types of gas valve controllers are known in the art. The gas valve controllers of the prior art have included a burner that is operatively connected to a valve that provides fuel to the burner. In certain instances, the valve is controlled by a controller that generates and transmits a control signal to the valve. In order to receive the control signal from the controller, a receiver is electrically connected to the valve. The receiver may be in wired or wireless communication with the controller. In the case of wireless communication between the controller and the receiver, the control signal may be transmitted by the controller to the receiver in the radio frequency (RF) band. Therefore, the control signal is able to penetrate walls. The control signal actuates the valve in order to adjust the heat. If more heat is requested, then the control signal instructs the valve to allow more fuel to reach the burner, resulting in the burner generating a larger flame and increased heat. On the other hand, if less heat is requested, the valve restricts the amount of fuel that reaches the burner generating a smaller flame, which produces less heat.

The prior art gas valve control systems related to the subject invention are used in various applications, including remote controlled fireplace. The gas valve control systems of the prior art, however, transmit the control signal as a RF signal or as an infrared (IR) signal. As soon as the receiver receives the control signal, the receiver processes the control signal and operates the fireplace in response to the control signal. Based on the characteristics of RF signals and IR signals, including the ability to travel great distances or penetrate walls, there is a risk that the control signal may be generated accidentally from another room than the fireplace. Therefore, there remains an opportunity to improve upon the gas valve control systems of the prior art by validating the control signal to verify that the controller transmitting the control signal was within a predetermined maximum distance from the receiver before the valve responds to the control signal. Also, there remains an opportunity to improve upon the gas valve control systems of the prior art to verify that the valve only responds to the control signal if the controller is within a line of sight relative to the receiver.

SUMMARY OF THE INVENTION AND ADVANTAGES

The invention provides for a gas valve control system that includes a burner. A valve is operatively connected to the burner for supplying fuel to the burner. A receiver having an antenna is electrically connected to the valve for providing the valve with a control signal. A controller having a control transmitter is in wireless communication with the receiver for transmitting the control signal to the receiver at a speed of light to control the valve. The invention further includes a validation transmitter disposed in the controller for transmitting a validation signal to the receiver at a speed of sound for enabling the valve if a time delay between the control signal and the validation signal is shorter than a maximum delay period and discarding the control signal if the time delay between the control signal and the validation signal is longer than the maximum delay period.

Accordingly, the control signal generated by the controller is validated by the validation signal generated by the controller. The validation signal verifies that the controller is within a maximum distance from the receiver at the time the control signal and the validation signal were transmitted to the receiver. Furthermore, the validation signal verifies that the controller is within a line of sight of the receiver at the time the control signal and the validation signal were transmitted to the receiver.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
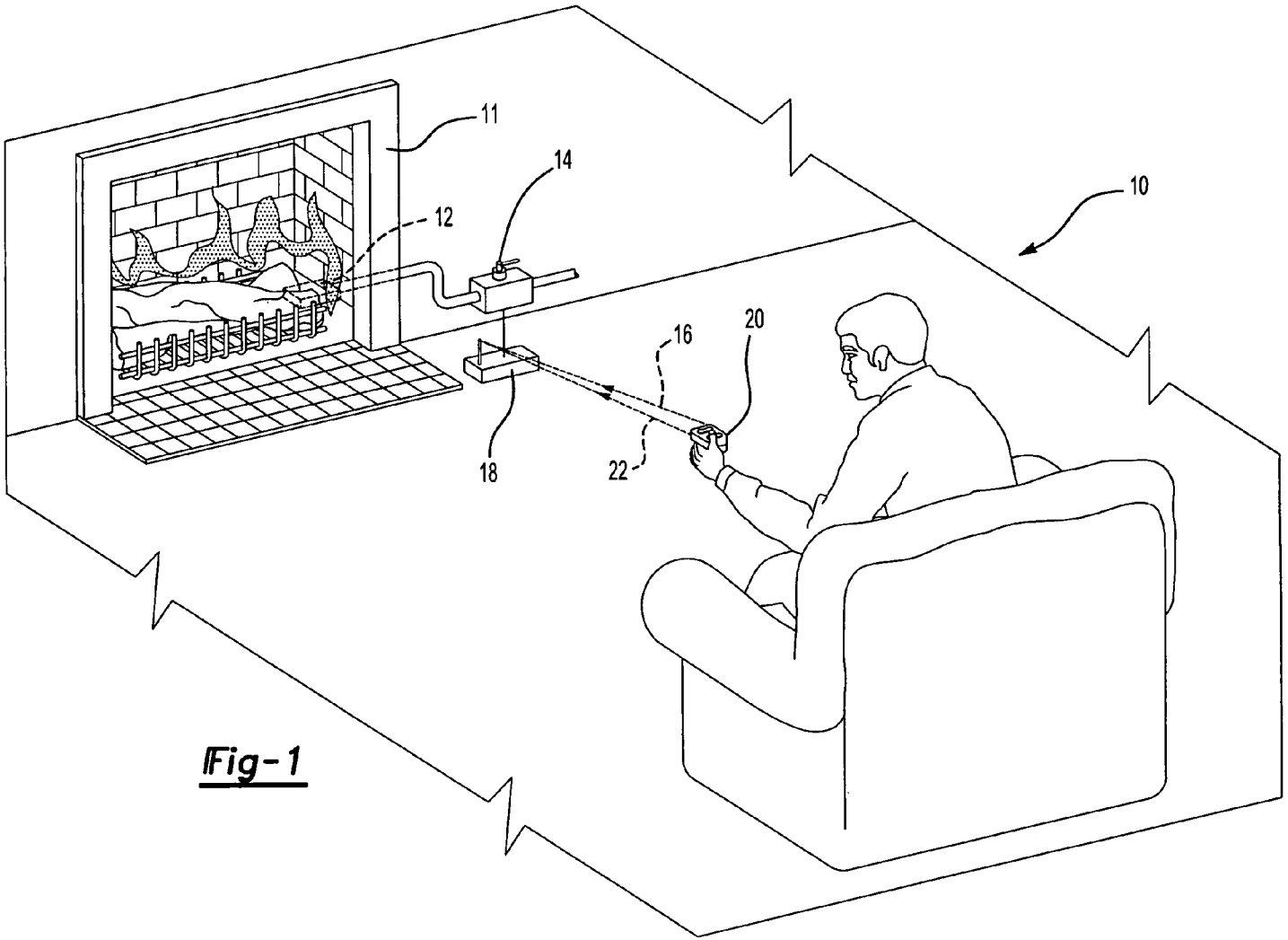
FIG. 1 is a drawing of an environment utilizing a gas valve control system in accordance with the subject invention.
Figure 2:
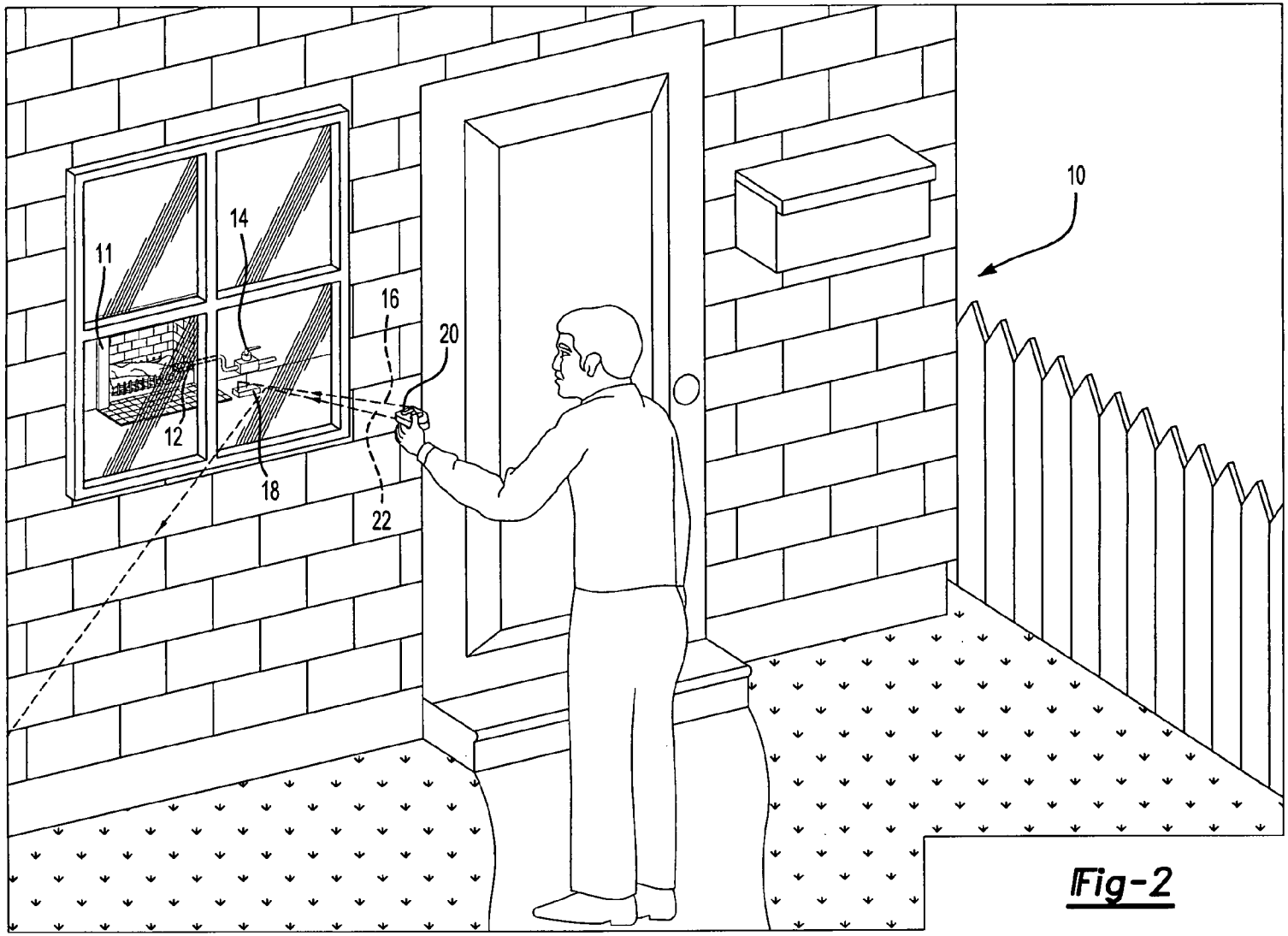
FIG. 2 is a drawing of the environment utilizing the gas valve control system in accordance with the subject invention.
Figure 3:
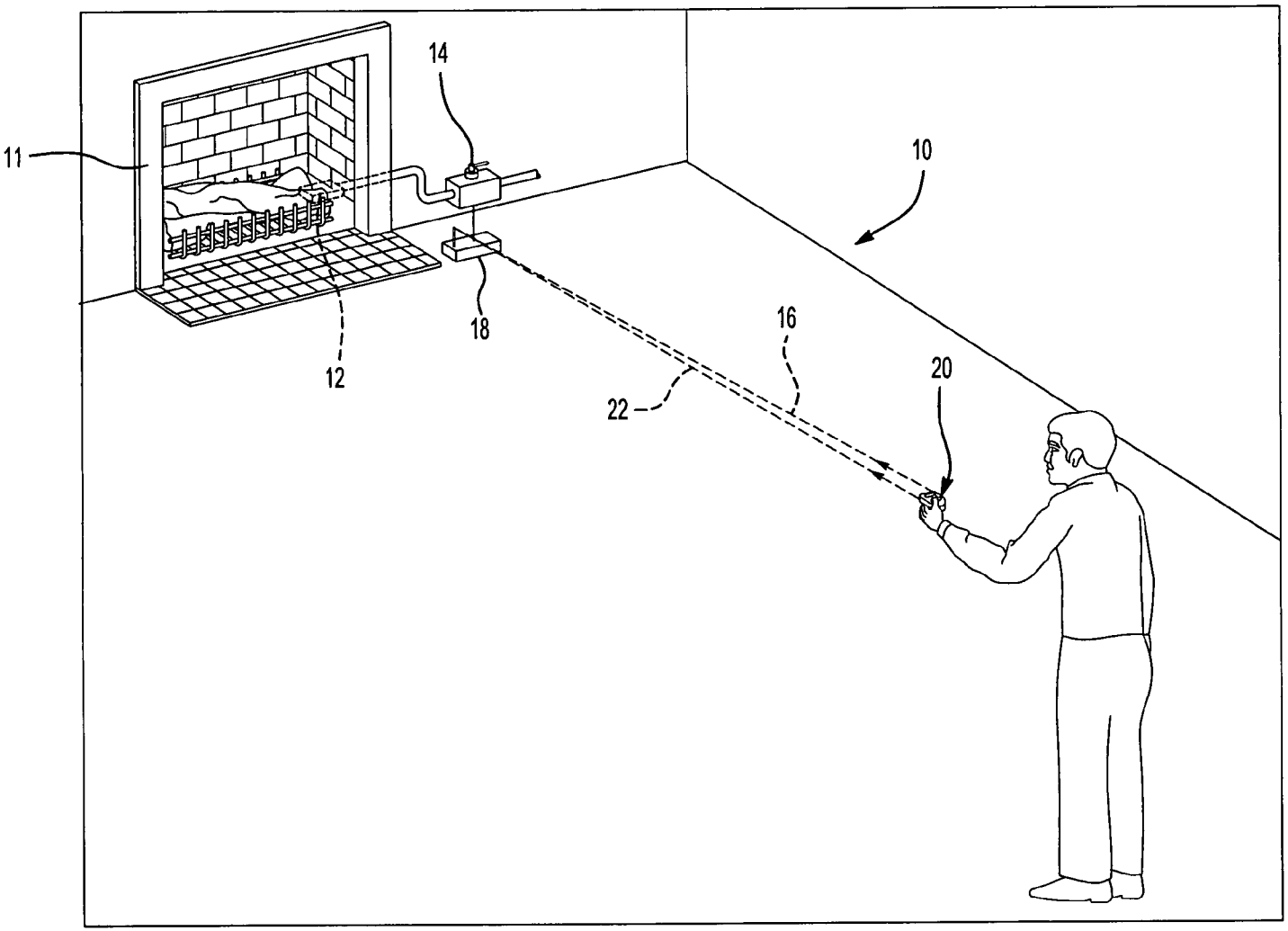
FIG. 3 is a drawing of the environment utilizing the gas valve control system in accordance with the subject invention.
Figure 4:
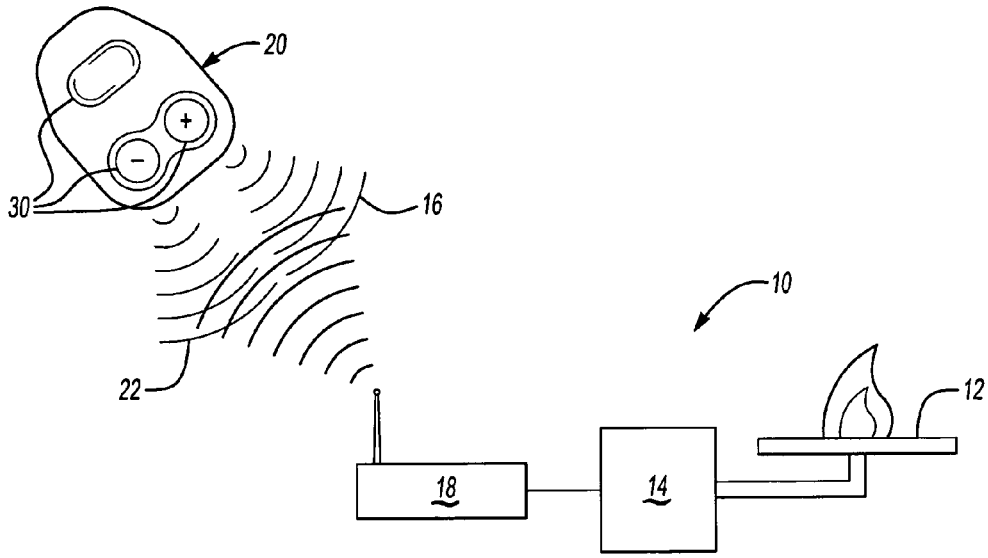
FIG. 4 is a schematic of the gas valve control system assembled in accordance with the subject invention.

Referring to the Figures, a gas valve control system is shown generally at 10. As shown in FIGS. 1-3, the gas valve control system 10 may be used with various types of heaters including, but not limited to, a remote controlled fireplace 11. Referring to FIGS. 1-4, the gas valve control system 10 of the subject invention includes a burner 12 that is disposed within the heater. The burner 12 ignites a fuel to produce a flame. The flame generates heat inside the heater to heat air passing though the heater. The burner 12 receives fuel from a valve 14 operationally connected between the burner 12 and a fuel source. The valve 14 is any type of valve known in the art that is controlled electronically with a control signal 16, such as a modulating valve. When the control signal 16 calls for increased heat, the valve 14 opens to allow more fuel to reach the burner 12, resulting in a larger flame since more fuel is consumed by the burner 12. The control signal 16 may also instruct the valve 14 to reduce the heat generated by the burner 12 by causing the valve 14 to reduce the amount of fuel that reaches the burner 12, resulting in a smaller flame since less fuel is consumed by the burner 12. Besides controlling heat, the valve 14 may supply more or less fuel to the burner 12 for aesthetic reasons, such as when the gas valve control system 10 is used with the remote controlled fireplace 11.

A receiver 18 is in electrical communication with the valve 14, and the receiver 18 transmits the control signal 16 to the valve 14. The valve 14 responds to the control signal 16 as described above. The control signal 16 is generated by a controller 20 that is in wireless communication with the receiver 18. The controller 20 transmits the control signal 16 to the receiver 18 and the receiver 18 transmits the control signal 16 to the valve 14. The control signal 16 may be transmitted from the controller 20 to the receiver 18 in various frequency bandwidths, and specifically, frequency bandwidths that are in the electromagnetic frequency spectrum since signals transmitted in the electromagnetic spectrum travel at the speed of light. For example, the control signal 16 may be transmitted from the controller 20 to the receiver 18 in a radio frequency (RF) bandwidth.

As previously stated, the control signal 16 includes information used to control the valve 14. Also, the control signal 16 includes information that the receiver 18 uses to recognize that the control signal 16 was transmitted by the controller 20. The control signal 16 may include, but is not limited to, a preamble, an ID tag, function data, and a post-amble. The preamble synchronizes the receiver 18 to the controller 20. The ID tag verifies that the control signal 16 is intended for the valve 14 to prevent another signal-transmitting device from enabling the valve 14. The function data instructs the valve 14 to perform various functions with respect to the valve 14 including increasing and decreasing heat. The post-amble indicates the end of the control signal 16.

Despite the verification measurements used by the control signal 16 and receiver 18 to ensure that the control signal 16 is meant for the receiver 18, additional measures may be taken to validate the control signal 16, especially since signals transmitted in the electromagnetic frequency spectrum can penetrate walls and other barriers that may come between the controller 20 and the receiver 18. In certain instances, it may be desired that the gas valve control system 10 only process the control signal 16 only if the control signal 16 was generated within the same room as the receiver 18 or within a certain distance of the receiver 18. This requires an additional level of validation. Therefore, before the control signal 16 is used to enable the valve 14, the receiver 18 validates the control signal 16 to ensure that the control signal 16 was generated by the controller 20 within a certain distance of the receiver 18 and that the controller 20 is within a line of sight of the receiver 18.

As a result, the controller 20 transmits a validation signal 22 to the receiver 18 in addition to the control signal 16. The receiver 18 enables the valve 14 with the control signal 16 only after the validation signal 22 has been received by the receiver 18 within a predetermined amount of time of the controller 20 transmitting the control signal 16. Similar to the control signal 16, the validation signal 22 is created by the controller 20 and is transmitted from the controller 20 to the receiver 18. Unlike the control signal 16, the validation signal 22 is transmitted from the controller 20 to the receiver 18 in a frequency band slower than the electromagnetic frequency spectrum. For example, the validation signal 22 may be transmitted in an ultrasonic frequency band, which travels at the speed of sound. In addition, ultrasonic signals do not penetrate walls so the validation signal 22 will only be received by the receiver 18 if the validation signal 22 is transmitted within the same room as the receiver 18. In addition, ultrasonic signals travel in a line of sight. Therefore, the receiver 18 will only receive the validation signal 22 if the controller 20 is pointed at the receiver 18. Since the validation signal 22 travels at the speed of sound and the control signal 16 travels at the speed of light, the control signal 16 will reach the receiver 18 first.

By way of example, as shown in FIG. 1, the controller 20 is pointed at the receiver 18 and the receiver 18 receives the validation signal 22 within the predetermined amount of time after receiving the control signal 16. Therefore, the burner 12 ignites the fireplace 11. Referring now to FIG. 2, the controller 20 is transmitting the control signal 16 from behind a barrier, such as a wall or window. Although the control signal 16 can penetrate the wall or window, the validation signal 22 cannot. Therefore, the fireplace 11 fails to ignite since the validation signal 22 fails to reach the receiver 18 within the predetermined amount of time. Next, as shown in FIG. 3, even though the controller 20 is within the line of sight of the receiver 18, the receiver 18 fails to receive the validation signal 22 within the predetermined amount of time, which indicates that the validation signal 22 was transmitted from too far away. Therefore, the fireplace 11 fails to ignite.

Figure 5:
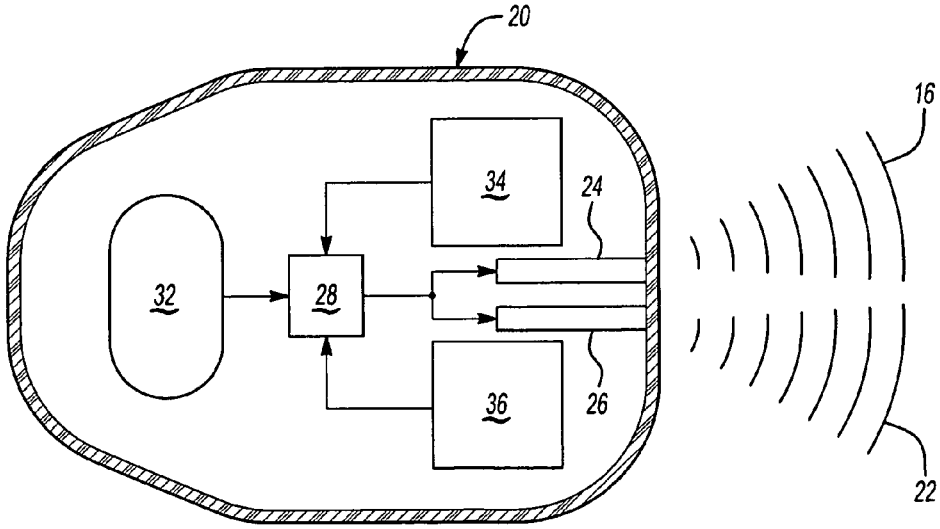
FIG. 5 is a schematic of a controller used in the gas valve control system in accordance with the subject invention.

Referring now to FIG. 5, the controller 20 is wirelessly connected to the receiver 18 and is responsible for generating the control signal 16 and the validation signal 22 and for transmitting the control signal 16 and the validation signal 22 to the receiver 18. The controller 20 transmits the control signal 16 to the receiver 18 using a control transmitter 24. The control transmitter 24 is disposed in the controller 20 and provides the control signal 16 with a carrier wave in the electromagnetic frequency spectrum as previously described. For example, the control transmitter 24 may be a RF transmitter. In addition, the controller 20 transmits the validation signal 22 to the receiver 18 using a validation transmitter 26 that is disposed in the controller 20. The validation transmitter 26 provides the validation signal 22 with a carrier wave in a frequency band slower than the electromagnetic frequency spectrum, such as the ultrasonic frequency band, as previously described. For example, the validation transmitter 26 may be an ultrasonic transmitter.

The controller 20 uses a signal generator 28 electrically connected to the control transmitter 24 and the validation transmitter 26 to generate the control signal 16 and the validation signal 22. The signal generator 28 combines the preamble, the ID tag, the function data, and the post-amble into the control signal 16, and then transmits the control signal 16 to the control transmitter 24. Likewise, the signal generator 28 generates the validation signal 22 and transmits the validation signal 22 to the validation transmitter 26. In order to enable the signal generator 28 to generate the control signal 16 and the validation signal 22, the controller 20 includes at least one input button 30. The input buttons 30 may include but are not limited to an ignite button 32 that causes the burner 12 to ignite, an increase heat button 34 that instructs the valve 14 to allow more fuel to reach the burner 12 and generate more heat, and a decrease heat button 36 that instructs the valve 14 to restrict the flow of fuel through the valve 14 to the burner 12 to reduce the amount of heat generated by the burner 12. After one of the input buttons 30 is pressed, the signal generator 28 generates the control signal 16 to carry out the function specified and the validation signal 22 to validate the control signal 16. The signal generator 28 sends the control signal 16 to the control transmitter 24 and the validation signal 22 to the validation transmitter 26, and the control transmitter 24 transmits the control signal 16 to the receiver 18 and the validation transmitter 26 transmits the validation signal 22 to the receiver 18.

Figure 6:
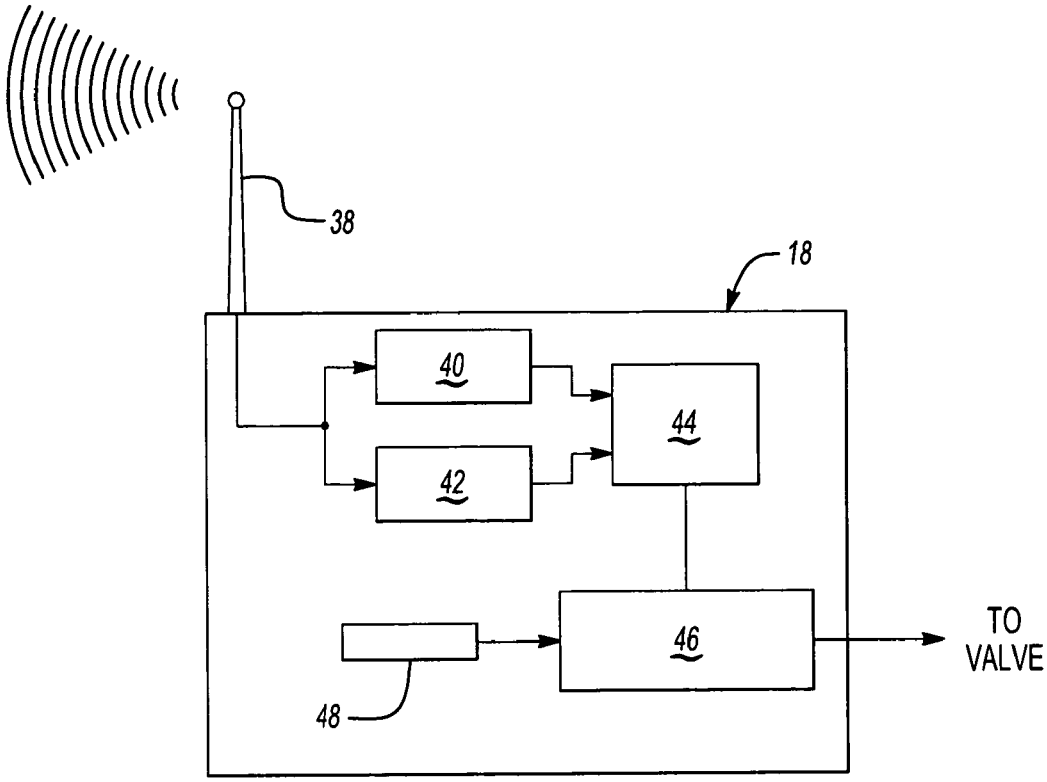
FIG. 6 is a schematic of a first embodiment of a receiver used in the gas valve control system in accordance with the subject invention.
Figure 7:
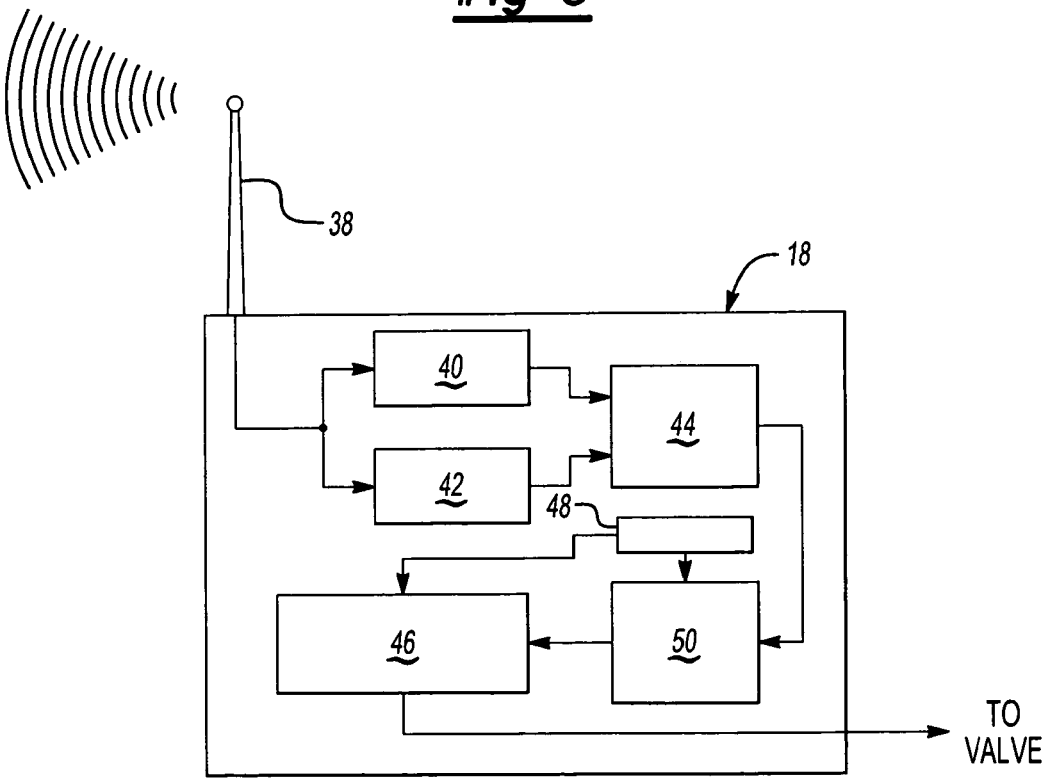
FIG. 7 is a schematic of a second embodiment of the receiver used in the gas valve control system in accordance with the subject invention.

Referring now to FIGS. 6 and 7, the receiver 18 includes hardware to receive and process the control signal 16 and the validation signal 22 and enable the valve 14 based on the control signal 16 and the validation signal 22. First, the control signal 16 and the validation signal 22 are received at the receiver 18 by an antenna 38. The antenna 38 is electrically connected to a control filter 40 that is disposed in the receiver 18. The control filter 40 is used to capture the control signal 16. The control filter 40 may be any type of known filter in the art capable of capturing signals in the electromagnetic frequency spectrum. For instance, the control filter 40 may be a high pass filter, a low pass filter, or a band pass filter depending on the frequency at which the control signal 16 is transmitted to the receiver 18. In addition, a validation filter 42 is disposed in the receiver 18 and electrically connected to the antenna 38. The validation filter 42 is used to capture the validation signal 22. The validation filter 42 may be any type of known filter in the art capable of capturing signals transmitted slower than signals transmitted in the electromagnetic frequency spectrum, such as signals transmitted in the ultrasonic frequency band. Like the control filter 40, the validation filter 42 may be a high pass filter, a low pass filter, or a band pass filter depending on the frequency at which the validation signal 22 is transmitted to the receiver 18.

Because the validation signal 22 is transmitted in a frequency band slower than the electromagnetic frequency spectrum, the validation signal 22 arrives at the receiver 18 later than the control signal 16. The difference in time between the receiver 18 receiving the control signal 16 and the receiver 18 receiving the validation signal 22 is defined by a time delay. In order to measure the time delay, a counter 44 is disposed in the receiver 18 and is in communication with the control filter 40 and the validation filter 42. The counter 44 begins counting once the control signal 16 is received by the receiver 18. The counter 44 may begin counting when the receiver 18 first begins to receive the control signal 16, or the counter 44 may begin counting after the receiver 18 has received the entire control signal 16.

The time delay between the receiver 18 receiving the control signal 16 and the validation signal 22 is related to the distance between the controller 20 and the receiver 18 at the time the control signal 16 and the validation signal 22 were transmitted and can be calculated if the speed of the validation signal 22 is known. Simply multiplying the speed of the validation signal 22 by the time delay results in the distance between the receiver 18 and the controller 20 at the time the validation signal 22 was transmitted. The speed at which the validation signal 22 travels may be well known in the art. For instance, if the validation signal 22 is transmitted in the ultrasonic frequency band, the speed of the validation signal 22 is the speed of sound. Although the speed of sound is affected by certain environmental conditions including temperature, elevation, and relative humidity among others, it may be approximated at about 300 m/s. Since velocity multiplied by time results in distance, multiplying the time delay by the speed of sound results in the distance between the controller 20 and the receiver 18 at the time the validation signal 22 was transmitted to the receiver 18. For example, the receiver 18 may be programmed to operate the valve 14 if the controller 20 is within 7 meters of the receiver 18. Therefore, the receiver 18 will only enable the valve 14 if the validation signal 22 is received within 23 milliseconds of the control signal 16 based on the speed of sound approximated to 300 m/s. Alternatively, if the validation signal 22 is received after 15.1 milliseconds, the receiver 18 will enable the valve 14 since the controller 20 is approximately 4.6 meters from the receiver 18. In yet another alternative, if the validation signal 22 is received after 35 milliseconds, the receiver 18 discards the control signal 16 because the controller 20 is approximately 10.5 meters from the controller 20, which, in this example, is beyond the 7-meter threshold. It should be understood that other distances may be used and the speed of sound may change based on environmental conditions.

It is possible for the control signal 16 to reach the receiver 18 without the validation signal 22 reaching the receiver 18 if the control signal 16 and the validation signal 22 are transmitted from another room or behind a wall. Since the control signal 16 is transmitted in the electromagnetic frequency spectrum, the control signal 16 will penetrate the wall. However, the validation signal 22 is only received by the receiver 18 when the controller 20 is in the line of sight of the receiver 18. As a result, the control signal 16 will reach the receiver 18 and the validation signal 22 will not. To prevent the counter 44 from waiting for the validation signal 22 indefinitely, the counter 44 may be programmed to discard the control signal 16 after a maximum delay period has been reached.

As shown in FIG. 6, in a first embodiment, a comparator 46 is disposed in the receiver 18 and is electrically connected to the counter 44 and to the valve 14. The comparator 46 receives the time delay from the counter 44 and compares the time delay to the maximum delay period that is predetermined and stored in a memory storage device 48. As previously stated, the maximum delay period is related to the maximum distance through the speed of the validation signal 22. Therefore, the comparator 46 can compare the time delay directly to the maximum delay period. If the time delay is shorter than the maximum delay period, the comparator 46 passes the control signal 16 to the valve 14, and the valve 14 responds to the function data transmitted in the control signal 16. If the time delay is greater than the maximum delay period, the comparator 46 discards the control signal 16 and the valve 14 fails to respond to the function data transmitted in the control signal 16.

However, as shown in a second embodiment in FIG. 7, it may be advantageous to convert the time delay to the distance between the controller 20 and the receiver 18, and compare the distance to a maximum distance. In order to calculate the distance, a processor 50 is disposed in the receiver 18 and is electrically connected between the counter 44 and the comparator 46. The processor 50 calculates the distance between the receiver 18 and the controller 20 based on the time delay. As previously described, the processor 50 calculates the distance between the receiver 18 and the controller 20 based on the time delay by multiplying the time delay by the speed at which the validation signal 22 is transmitted. The processor 50 is electrically connected to and accesses the memory storage device 48 that stores the speed at which the validation signal 22 is transmitted.

After the processor 50 calculates the distance between the receiver 18 and the controller 20, the comparator 46, in this embodiment, compares the distance between the receiver 18 and the controller 20 to a maximum distance. The maximum distance is stored in the memory storage device 48. If the distance between the controller 20 and the receiver 18 is lower than the maximum distance, the comparator 46 passes the control signal 16 to the valve 14 and the valve 14 responds to the function data transmitted in the control signal 16. If the distance is greater than the maximum distance, the comparator 46 discards the control signal 16 and the valve 14 fails to respond to the function data transmitted in the control signal 16.

Obviously, many modifications and variations of the present invention are possible in light of the above teachings and the invention may be practiced otherwise than as specifically described within the scope of the appended claims.

What is claimed is:

1. A gas valve control system comprising:

a burner;

a valve operatively connected to said burner for supplying fuel to said burner;

a controller including a control transmitter for transmitting a control signal at a speed of light to control said valve; and a validation transmitter for transmitting a validation signal at a speed of sound; and a receiver electrically connected to said valve and including an antenna for receiving the control signal and the validation signal from said controller;

a counter for measuring the time delay between the control signal and the validation signal; a processor electrically connected to said counter for calculating a distance between said receiver and said controller based on the time delay;

a comparator electrically connected to said processor for comparing the distance calculated by said processor to a maximum distance and either passing the control signal to said valve or preventing the control signal from reaching said valve based on the time delay; and said comparator passes the control signal to said valve in response to the distance being lower than the maximum distance and discards the control signal in response to the distance being greater than the maximum distance.

2. A gas valve control system as set forth in claim 1 wherein said processor calculates the distance between said receiver and said controller by multiplying the time delay by the speed of sound.

3. A gas valve control system as set forth in claim 1 further including a control filter disposed in said receiver and electrically connected between said antenna and said counter for distinguishing the control signal from the validation signal.

4. A gas valve control system as set forth in claim 3 further including a validation filter disposed in said receiver and electrically connected between said antenna and said counter for distinguishing the validation signal from the control signal.

5. A gas valve control system as set forth in claim 1 wherein said control transmitter transmits the control signal in an electromagnetic frequency spectrum.

6. A gas valve control system as set forth in claim 5 wherein the electromagnetic frequency spectrum is further defined as a radio frequency band.

7. A gas valve control system as set forth in claim 1 wherein said validation transmitter transmits the validation signal in an ultrasonic frequency band.

8. A gas valve control system as set forth in claim 1 further including a signal generator disposed in said controller and electrically connected to said control transmitter for generating the control signal.

9. A gas valve control system as set forth in claim 8 wherein said signal generator is electrically connected to said validation transmitter for generating the validation signal.

10. A gas valve control system as set forth in claim 8 further including an input operatively connected to said controller for enabling said signal generator to create the control signal and the validation signal and to transmit the control signal and the validation signal to said receiver.

11. A gas valve control system as set forth in claim 10 wherein said input is further defined as an ignite button for enabling said controller to transmit the control signal and the validation signal to said receiver to ignite said burner.

12. A gas valve control system as set forth in claim 10 wherein said input includes an increase heat button for enabling said controller to transmit the control signal and the validation signal to said receiver to instruct said valve to provide more fuel to said burner.

13. A gas valve control system as set forth in claim 10 wherein said input includes a decrease heat button for enabling said controller to transmit the control signal and the validation signal to said receiver to instruct said valve to provide less fuel to said burner.

14. A gas valve control system as set forth in claim 1 further comprising a memory storage device disposed in said receiver and electrically connected to said comparator for storing the maximum distance.

* * * * *

UNITED STATES PATENT AND TRADEMARK OFFICE

CERTIFICATE OF CORRECTION

PATENT NO. : 7,823,581 B2
APPLICATION NO. : 11/403553
DATED : November 2, 2010
INVENTOR(S) : Juan F. Velazquez and Barbara Happe It is certified that error appears in the above-identified patent and that said Letters Patent is hereby corrected as shown below:

On the title page: Item 75

Inventors: "Juan F. Velasquez" should read -- Juan F. Velazquez --.

Signed and Sealed this
Twenty-eighth Day of December, 2010

David J. Kappos

David J. Kappos
*Director of the United States Patent and Trademark Office*